United States Patent [19]

Torance

[11] 3,975,820

[45] Aug. 24, 1976

[54] RAZORS AND BLADE CARTRIDGE THEREFORE

[76] Inventor: William Robert Lincoln Torance, 5 Lamont Ave., Agincourt, Ontario, Canada

[22] Filed: May 12, 1975

[21] Appl. No.: 576,884

[52] U.S. Cl. ..... 30/47; 30/50; 30/89

[51] Int. Cl.[2] ..... B26B 21/14; B26B 21/52

[58] Field of Search ..... 30/37–39, 30/47, 50, 57, 87–89, 346.57, 346.58

[56] References Cited

UNITED STATES PATENTS

| | | | |
|---|---|---|---|
| 1,441,016 | 1/1923 | Matthews | 30/50 |
| 1,923,439 | 8/1933 | Hukill | 30/50 |
| 3,816,914 | 6/1974 | Wordtmann | 30/47 X |

FOREIGN PATENTS OR APPLICATIONS

| | | | |
|---|---|---|---|
| 468,611 | 11/1928 | Germany | 30/89 |

*Primary Examiner*—Al Lawrence Smith
*Assistant Examiner*—Gary L. Smith
*Attorney, Agent, or Firm*—K. M. Hill

[57] ABSTRACT

The specification discloses a razor assembly comprising a handle having a yoke-shaped extension therein into which a double-edged and double-sided blade cartridge interfits for rotatable positioning between the yoke. An ejector and stop means is located at the base of the yoke to hold the blade cartridge in one of two shaving positions with an ejector actuation means operable from the handle of the razor.

1 Claim, 3 Drawing Figures

RAZORS AND BLADE CARTRIDGE THEREFORE

FIELD OF INVENTION

The present invention relates to safety razors and blades used therewith. In particular the present invention relates to disposable razor blade holding cartridges and the means for retaining same within a razor.

PRIOR ART

It is known to use parallel spaced apart and outwardly facing cutting edges on blades as used in safety razors. It is also known to provide parallel disposed blades offset one to another but facing in the same direction, in a cartridge whereby the two blades are fixed for use in a razor; its one blade being adapted to follow the other closely across the surface to be shaved. It is known to design the razor to maintain the cartridge, holding blades in a set fixed position with relation to the handle of the razor to insure that the pair of blades in echeloncut along the surface at a constant angle consonant with a predetermined suitable angle for comfort and efficiency.

OBJECT OF INVENTION

The object of the present invention is to combine the double-edged or sided blade with the cartridge fixed pair of blades to give a double edged and double sided cartridge for use in a razor adapted to hold said novel cartridge between, and rotatable within, a pair of arm members of the razor.

Another object is to make better use of the cartridge device for holding blades by connecting it to a double-edged device.

A further object of the invention is to construct a razor with means associated therewith whereby the cartridge of the present invention can be freely fitted and ejected from a razor and can also be rotated between one operable position to another operable position.

With the foregoing objects in view, and such other or further purposes, advantages or novel features as may become apparent from consideration of this disclosure and specification, the present invention consists of the inventive concept which is comprised, embodied, embraced, or included in the means, method, process, product, construction, composition, arrangement of parts, or new use of any of the foregoing herein exemplified in one or more specific embodiments of such concept, reference being had to the accompanying drawings in which.

In the various figures like reference numerals refer to like parts.

PREFERRED EMBODIMENT

Figure 1:
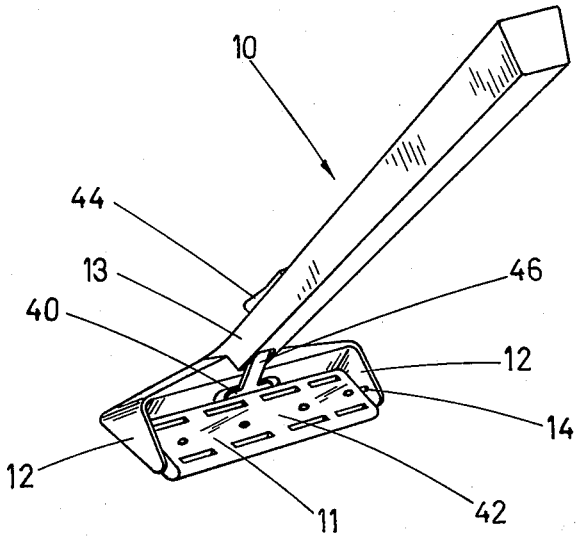
FIG. 1 is a perspective view of the razor of the present invention showing a blade holding cartridge interfitted between the arms of the razor head.

The preferred embodiment of the invention is shown in the drawings where numeral 10 refers to a razor having the novel cartridge 11, of the invention attached to extended arms 12 disposed downwardly from the head 13 of the razor 10. Projections 14, 15 are formed into the arms 12 of the razor head 13 into which dimple means 16, 17 formed in the mid section of the ends of the cartridge mate for rotational movement of the cartridge 11 between and within the arms 12 of the razor head 13.

Figure 3:
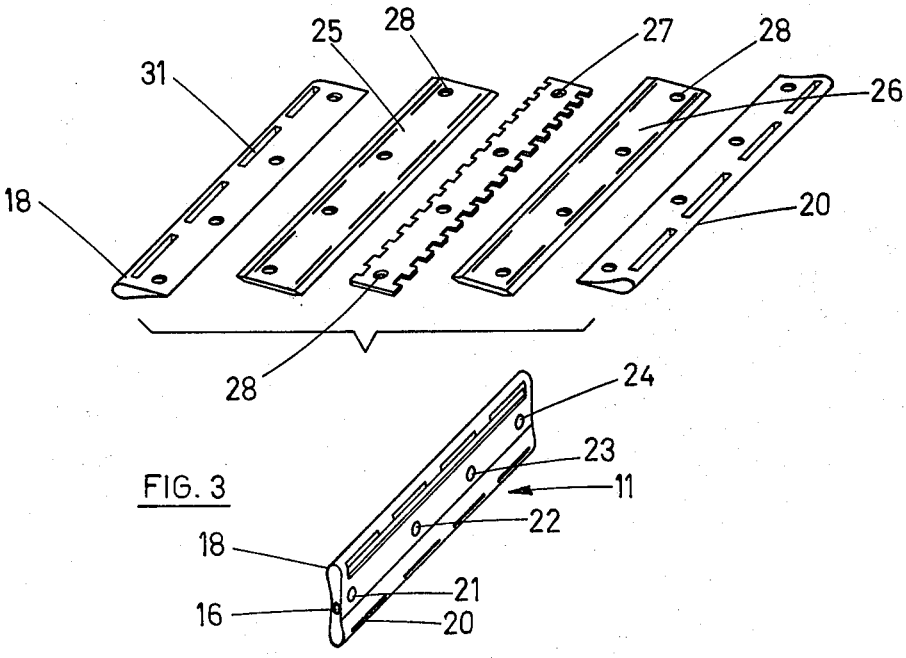
FIG. 3 is an exploded view of the cartridge of the present invention showing the means of attaching the blades together prior to sealing in the cartridge.

In FIG. 3 the cartridge 11 is shown exploded with one slotted body 18 detached from one side and the other blade receiving and slotted body 20 detached from the opposite side. When attached together the parts are held by rivets 21, 22, 23, 24.

The blade members are shown as 2 separate blades 25, 26, with chisel ground faces or edges along each side parallel with one another.

A spacer member 27 is adapted to fit between the blades 25, 26. A row of rivet-receiving openings 28 are formed through the spaces and through each of the blades.

The openings 28 are located along the centre of spacer 27 but are offset in each of the blades to provide a means for offsetting the blade edge of one blade with relation to the edge of the other blade, thereby to insure that when spaced apart in body 20 one edge is offset above one blade but is offset below the other blade where it emerges from the slot 31 on body 18.

It will be apparent from the above described construction of a cartridge that a double sided blade can be easily interfitted therein to overlie a second blade to provide a double tracked or slotted face to the shaving head on each of two opposite sides of the cartridge thereby giving a cartridge double the useful life presently known.

Figure 2:
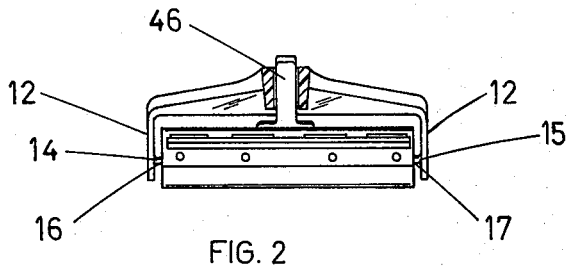
FIG. 2 is an end view of the razor showing a pair of blades disposed for shaving action when the cartridge is in one of the two positions.

Returning to FIGS. 1 and 2, the applicant shows a stop dog 40 which functions to arrest rotation of the Cartridge 11 about the projections 14 and 15 when the razor is in use against a surface being shaved. The stop dog 40 will allow the cartridge to be rotated in one direction only to permit the user to change from one pair of blades on one edge to the pair of blades on the opposite edge of the cartridge without the necessity of withdrawing the cartridge from the razor.

To load the razor in the first instance with a cartridge a user will push the razor down onto a cartridge which is resting on its one edge with the second blade edge facing upwardly in a cartridge case dispenser until the projections of the razor snap into the dimple means centrally formed on each end of the cartridge. It is contemplated that a simple variation of a known cartridge dispenser can be used since it is merely necessary that the dispenser holds the cartridge in an upright on edge position for the present invention.

After being interfitted between the arms 12 of the razor head 13, the cartridge 11 can be rotated into the correct shaving position to give the correct angle to the blades by a gentle push of the users thumb against the centre face 42 of the cartridge 11, until arrested by stop dog 40.

To release the used blade the user can pull the cartridge from between the arms of the razor with his thumb and forefinger or he can push down on a cartridge ejector button 44 located on the upper side of the razor.

The ejector button is connected by suitable lever means 46 to the stop dog 44 and will, when depressed, force the dog against an edge of the cartridge thereby to effect ejection of the cartridge from the razor.

It will be understood that the cartridge of the present invention and the razor developed to combine therewith could each be adapted for use with known razors and cartridges respectively and it is contemplated that various modifications could be made to the invention as depicted and described herein and be within the scope of the concept and embodiment disclosed.

I claim:

1. A razor comprising in combination; a pair of blades, each having a pair of parallel oppositely facing cutting edges therein, each blade spaced apart from the other by a spacer plate held therebetween; a handle member having a pair of spaced apart extensions thereon forming a yoke therebetween; means for fastening said pair of blades and said spacer together as a unit with their blade edges in parallel and having side edges substantially perpendicular thereto; means for swivelably holding said blade unit within said yoke; inwardly facing projections on each arm of the yoke of said handle adapted to mate with dimples formed in the sides of a cartridge member holding said blades and said spacer in a unitary body, thereby to permit rotational movement of said cartridge within said yoke; and stop means on said handle between said extensions to prevent said cartridge from rotating during use of the razor for shaving, said stop means being outwardly moveable between said yoke arms by interconnection with an ejection lever downwardly pivotable from said handle to force said projections out of said dimples in said cartridge.

* * * * *